US010016906B2

(12) United States Patent
Baba et al.

(10) Patent No.: US 10,016,906 B2
(45) Date of Patent: Jul. 10, 2018

(54) SHEET CUTTER

(71) Applicant: SEIKO LTD., Kawasaki-shi, Kanagawa (JP)

(72) Inventors: Kenji Baba, Kawasaki (JP); Chiaki Osada, Kawasaki (JP); Hirokazu Tanaka, Kawasaki (JP)

(73) Assignee: SEIKO LTD., Kawasaki-shi, Kanagawa (JP)

( * ) Notice: Subject to any disclaimer, the term of this patent is extended or adjusted under 35 U.S.C. 154(b) by 103 days.

(21) Appl. No.: 14/965,252

(22) Filed: Dec. 10, 2015

(65) Prior Publication Data

US 2016/0185004 A1 Jun. 30, 2016

(30) Foreign Application Priority Data

Dec. 24, 2014 (JP) ..... 2014-260475

(51) Int. Cl.

| | |
|---|---|
| ***B26D 1/18*** | (2006.01) |
| ***B26D 7/02*** | (2006.01) |
| ***B26D 5/10*** | (2006.01) |
| ***B26D 1/04*** | (2006.01) |
| ***B26D 9/00*** | (2006.01) |
| ***B26F 1/02*** | (2006.01) |

(52) U.S. Cl.

CPC ..... *B26D 7/025* (2013.01); *B26D 1/045* (2013.01); *B26D 5/10* (2013.01); *B26D 9/00* (2013.01); *B26F 1/02* (2013.01); *Y10T 83/8769* (2015.04)

(58) Field of Classification Search

CPC ..... B26D 1/185; B26D 1/045; B26D 1/065; B26D 1/205; B26D 9/00

USPC ..... 83/51, 578, 614

See application file for complete search history.

(56) References Cited

U.S. PATENT DOCUMENTS 2,327,223 A * 8/1943 Silver ..... B26D 1/205 83/174
3,071,034 A * 1/1963 Castelli ..... A61F 15/002 83/578
3,919,905 A * 11/1975 Hoffman ..... B65H 35/006 83/205
5,287,783 A * 2/1994 Mori ..... B26D 1/18 83/455

(Continued)

FOREIGN PATENT DOCUMENTS

JP H07-000651 A 1/1995
JP 4783912 B2 9/2011

*Primary Examiner* — Kenneth E Peterson
(74) *Attorney, Agent, or Firm* — Manabu Kanesaka

(57) ABSTRACT

A sheet cutter is operable by one hand for maintaining a sheet on a placing table and by other hand for cutting the sheet to ensure safety of finger of the one hand. The sheet cutter includes a pressing operating member adapted to be depressed from a non-pressing position to a pressing position for maintaining the sheet on the placing table against a biasing force of a spring, and a cutting operating member for travelling a cutter unit between one end and another end of the placing table, wherein the pressing operating member and the cutting operating member are arranged at different positions with a certain interval to set their operating directions orthogonal to each other. Accordingly, a sheet on the placing table can be cut by operating the cutting operating member horizontally with the other hand while operating the pressing operating member vertically with the one hand.

13 Claims, 11 Drawing Sheets

(56) References Cited

U.S. PATENT DOCUMENTS

| | | | | |
|---|---|---|---|---|
| 5,442,983 | A * | 8/1995 | D'Angelo | B26D 1/045 83/208 |
| 6,148,706 | A * | 11/2000 | Witjes | B26D 1/245 83/488 |
| 7,406,904 | B2 * | 8/2008 | Antal | B26D 1/045 225/42 |
| 7,921,756 | B2 * | 4/2011 | Vegliante | B26D 1/065 83/374 |
| 2002/0148337 | A1 * | 10/2002 | Takabatake | B26D 1/0006 83/614 |
| 2006/0150794 | A1 * | 7/2006 | Kim | B26D 1/245 83/614 |
| 2009/0107314 | A1 * | 4/2009 | Nasu | B26D 7/08 83/86 |

* cited by examiner

SHEET CUTTER

RELATED APPLICATIONS

The present application is based on, and claims priority from, Japanese Application No. 2014-260475 filed Dec. 24, 2014, the disclosure of which is hereby incorporated by reference herein in its entirety.

BACKGROUND OF THE INVENTION

1. Field of the Invention

The present invention relates to a sheet cutter for cutting an object to be cut such as a sheet, and more particularly an improvement of a cutting mechanism that enables perfect cutting with a simple structure.

2. Description of the Related Art

In an ordinary device for cutting a sheet or the like, a sheet or sheets are set on a placing table mounted on an installation plane such as a table to be maintained thereon by a press mechanism, and are cut by a cutting blade.

A cutting mechanism including a cutting blade of a short sword or knife shape pivotally and swingably supported at one end thereof, in which a sheet placed on a placing table is cut by an action of pressing down the cutting blade from an initial upper position, has been known in the art. For example, Japanese Patent No. 4783912 discloses a cutting machine, in which a cutter blade rotatably supported at one end thereof is operated downward to cut sheets which are placed on a flat surface of a base and retained thereon by a paper presser, along a side edge of the base.

Another cutting mechanism including a circular blade or a rectangular blade of a chisel shape, in which the blade travels along a cutting line to cut a sheet or sheets on a placing table, has been known in the art. For example, Japanese patent application publication No. 07-000651 describes a sheet cutter, in which a base is placed on a sheet to be cut, and a blade mounted on the base to project downward through a through groove formed in the base is moved along a rail to cut the sheet.

Further, in order to maintain sheets on a placing table, a cutting mechanism which is provided with a cutting blade that is moved downward to cut the sheets, and a pressing part that is operated to press the sheets on the placing table interlocking with a cutting action of the cutting blade has been known in the art.

In the above conventional technology, an object to be cut such as a sheet is pressed and retained on a placing plane by an initial action of a cutting operation, or by a pressing mechanism which is operated separately from and prior to a cutting operation by a cutter.

However, it is not always easy for an unskilled user to perform both an action of pressing sheets and an action of cutting sheets at different timings, and there is a risk of injuring the user's hand or fingers during the cutting operation by mistake. For example, when moving a cutting blade in a cutting direction with one hand while setting the sheets on the placing table with the other hand, it may cause injury of the other hand or its fingers, if adequate attention is not paid.

SUMMARY OF THE INVENTION

An object of the present invention is to provide a sheet cutter which is operable by one hand for maintaining a sheet on a placing table and by the other hand for cutting the sheet, so as to ensure safety of the finger of the one hand, thus enabling safe cutting operation of the cutter.

According to the present invention, there is provided a sheet cutter comprising:

a cutter unit;

a placing table having a placing plane for an object to be cut;

a pressing part for depressing the object to be cut on the placing table; and a guide member for the cutter unit being arranged from one end to other end of the placing table;

wherein the pressing part comprises:

a pressing member movable between a pressing position and a non-pressing position, a biasing member for biasing the pressing member toward the non-pressing position, and a pressing operating member for pressing the pressing member down from the non-pressing position to the pressing position;

the cutter unit comprises:

a holder member being slidably supported by the guide member, a blade member being attached to the holder member, and a cutting operating member for travelling the holder member along the guide member; and the pressing operating member and the cutting operating member are arranged at different positions with a certain interval to set their operating directions orthogonal to each other.

With this arrangement of the pressing operating member and the cutting operating member, a user is able to operate the pressing operating member with one hand for pressing the object to be cut or sheets on the placing table and at the same time operate the cutting operating member with the other hand for cutting the sheets on the placing table, thereby eliminating a risk of injuring the user's hand and fingers.

Also, a need of providing a guard structure for protecting a user's hand and fingers in a certain area during operating the cutter unit or blade which may cause an increase of costs and a reduction in operability is eliminated.

According to one embodiment of the invention, the operating direction of the pressing operating member is set to be vertical to the placing surface of the placing member, and the operating direction of the cutting operating member is set to be parallel to the placing plane of the placing member.

The placing table and the objects to be cut are ensured to be retained in position by a vertical pressurizing force executed by the pressing operating member, while the cutter unit is operated to travel in a horizontal direction. Therefore, any movement or shift of the placing table can be avoided during the cutting operation.

The foregoing and other objects, features and advantages of the present invention will be apparent from the following description of a preferred embodiment of the invention, as illustrated in the accompanying drawings.

DESCRIPTION OF THE PREFERRED EMBODIMENTS

Figure 1:
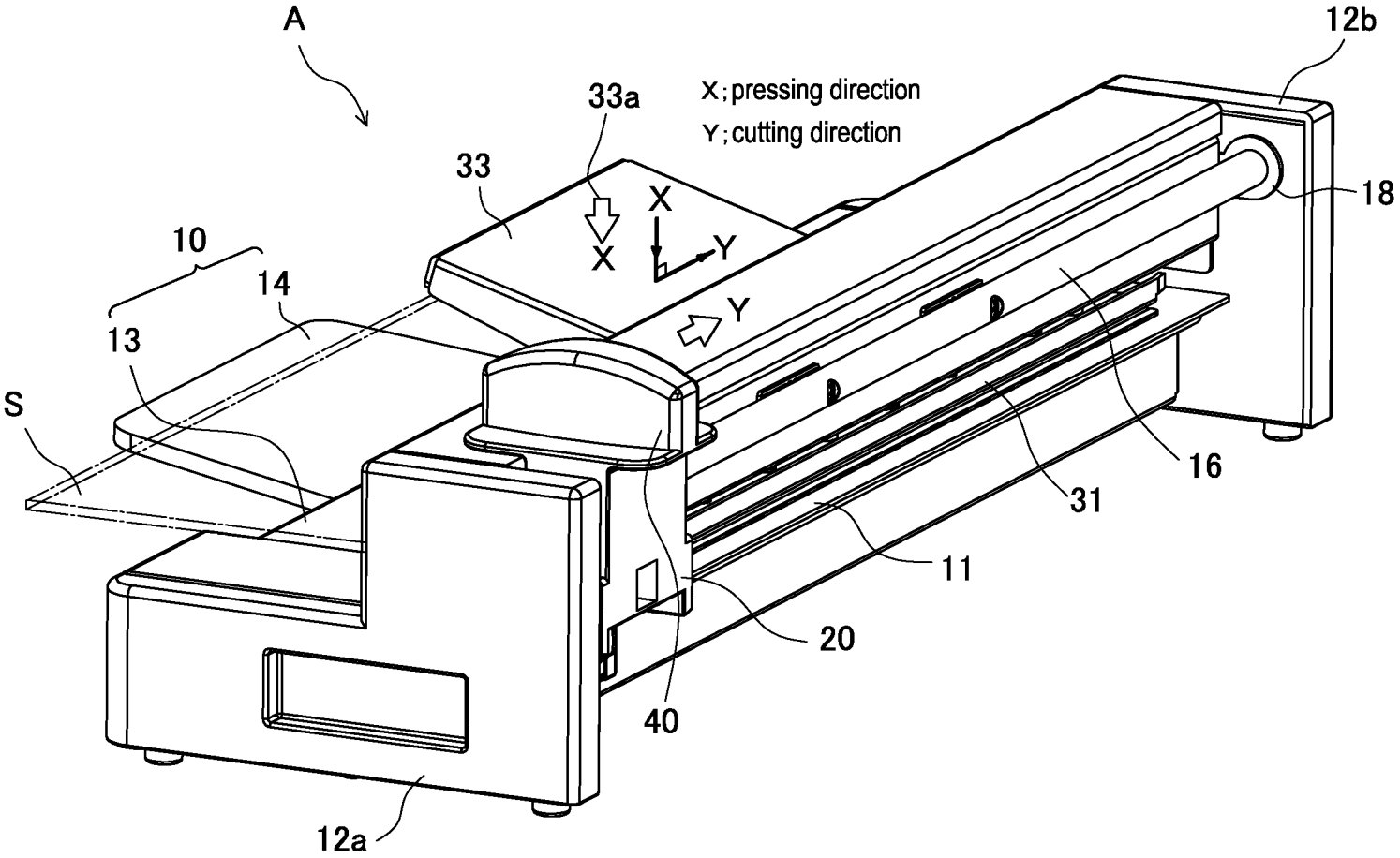
FIG. 1 is an overall perspective view of a sheet cutter according to the present invention.

FIG. 1 illustrates a sheet cutter A comprising a sheet placing table 10, a cutter unit 20, a cutter travelling mechanism, and a pressurizing mechanism 30 according to a preferred embodiment of the present invention. While an object to be cut (hereinafter referred as "sheet") is set or placed on the placing table 10 and maintained thereon by the pressurizing mechanism 30, the cutter unit 20 is operated to travel from one end Cs to the other end Ce of the placing table to cut the sheet. Each above component of the sheet cutter will now be described in detail below.

[Sheet Placing Table]

The sheet placing table 10 comprises a sheet placing plane 11 formed of a main tray 13 and a sub tray 14, and a pair of opposed left and right side frames 12 (12*a*, 12*b*). As shown in the drawing, the sub tray 14 is fitted into the main tray 13 to be capable of being inserted into and drawn out therefrom. Sheets of a smaller size are supported only by the main tray 13, and sheets of a larger size are supported by both the main tray 13 and the sub tray 14.

The pair of side frames 12 are integrally assembled with the placing table 10 with the left and right side frames 12*a*, 12*b* being separated at such a distance that a maximum sized sheet can be placed on the placing plane 11. A guide member 16, a second guide member 17 and a rotation supporting shaft 18 are provided between the side frames 12*a*, 12*b*, as will be described below. The cutter unit 20 is movably supported on the guide member, and a pressing operating member (pressure operating lever) 33 for pressing and keeping a sheet S onto the placing plane is swingably supported onto the rotation supporting shaft 18.

In the illustrated embodiment, the first guide member 16 and the rotation supporting shaft 18 are formed of a rod member being provided to extend between the side frames 12*a*, 12*b*. Hereinafter, this rod member (16, 18) is to be referred as the "guide member 16" when it acts for guiding the cutter unit 20, and is also to be referred as the "rotation supporting shaft 18" when it acts for supporting rotation of the pressing operating member 33. Alternatively, the guide member 16 and the rotation supporting shaft 18 can be formed of separate rod members respectively.

Figure 3:
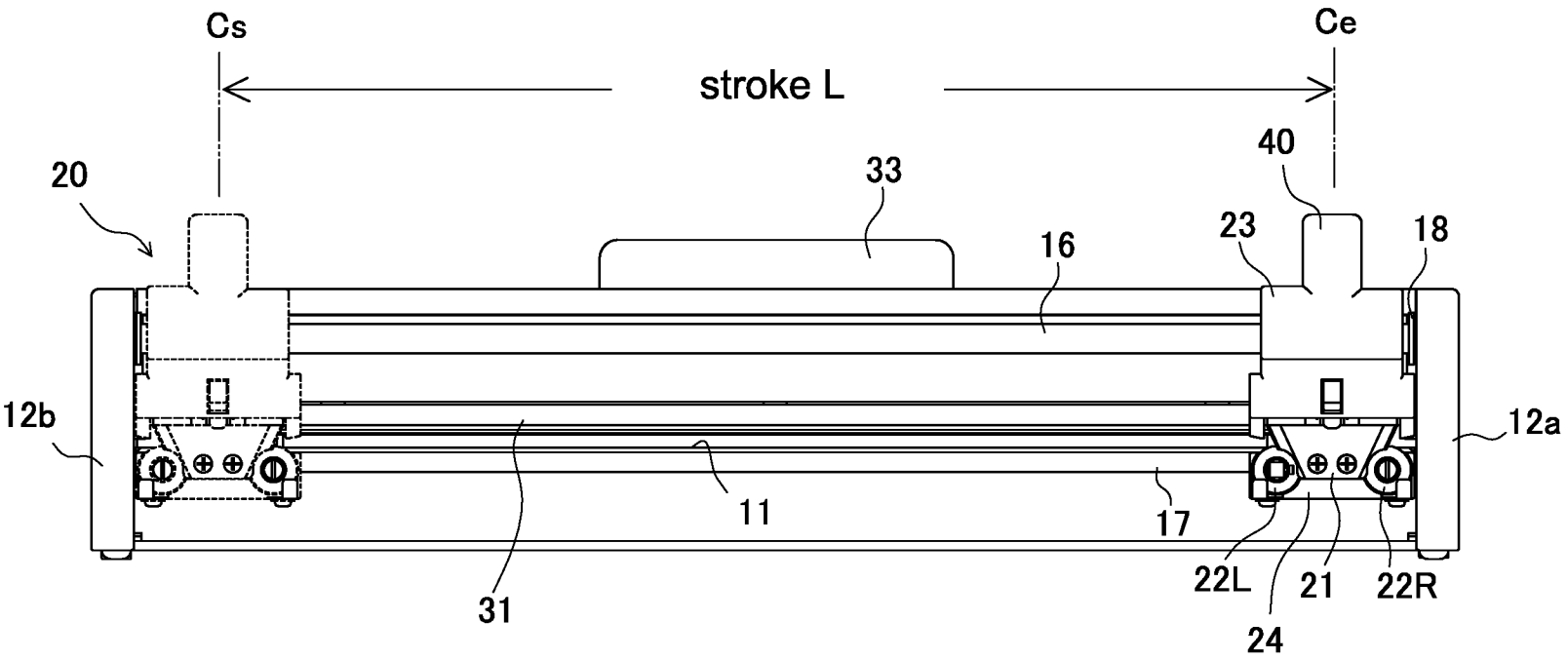
FIG. 3 is a front view of the sheet cutter in FIG. 1.

As shown in FIG. 3, the guide members (the first guide member 16 and the second guide member 17) are disposed between the side frames 12*a*, 12*b*, and the cutter unit 20 is supported by both the guide members 16, 17 to reciprocatingly travel therealong. A travel stroke of the cutter unit 20 is set corresponding to a maximum cutting length of the placing table 11 for the maximum sized sheet. Here, the above mentioned rod member constitutes the guide member 16 for guiding the cutter unit 20 within the travel stroke L, and the rotation supporting member 18 for rotationally supporting the pressing operating member 33 outside the travel stroke.

Figure 4:
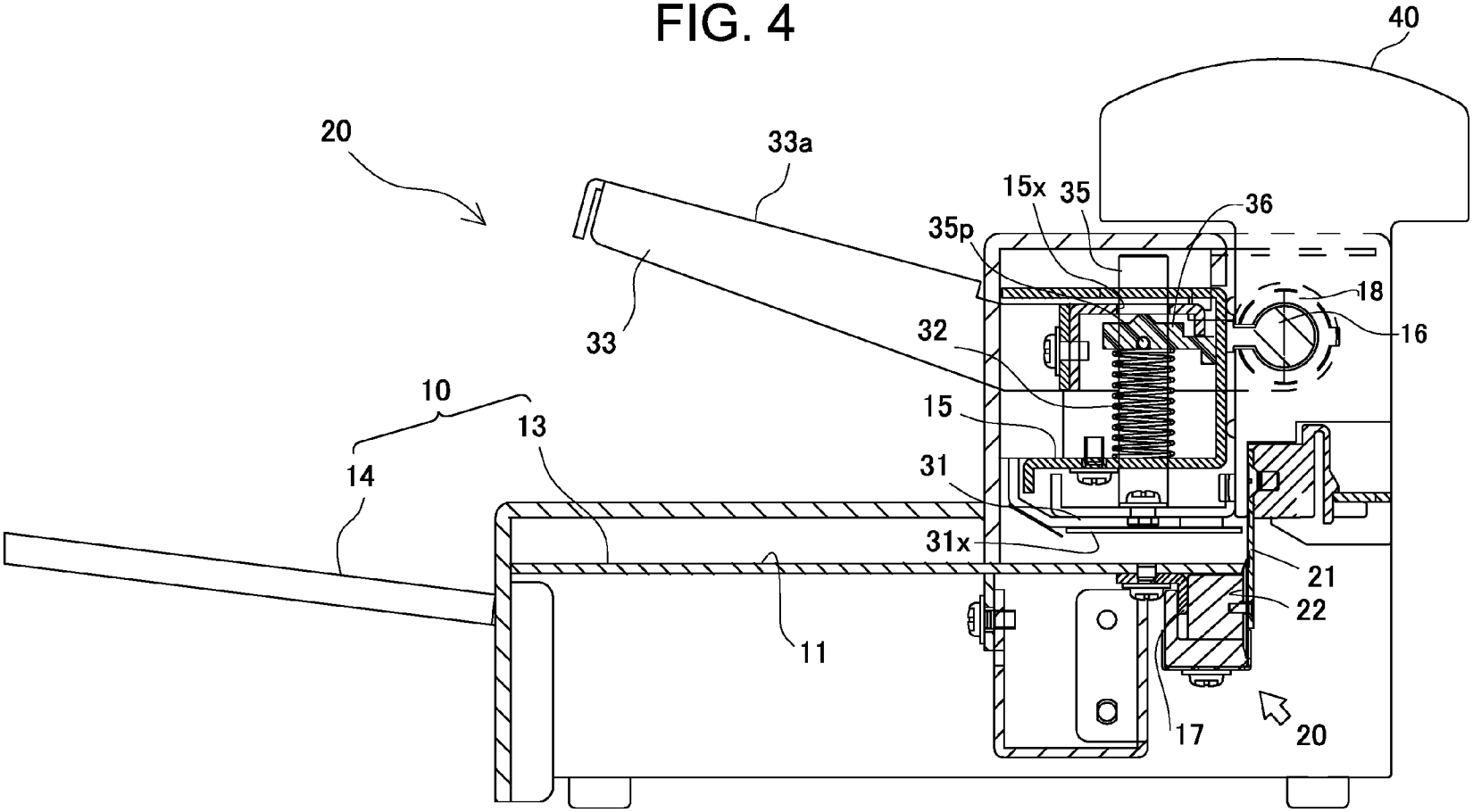
FIG. 4 is a cross-sectional view of the sheet cutter in FIG. 1.
Figure 5A:
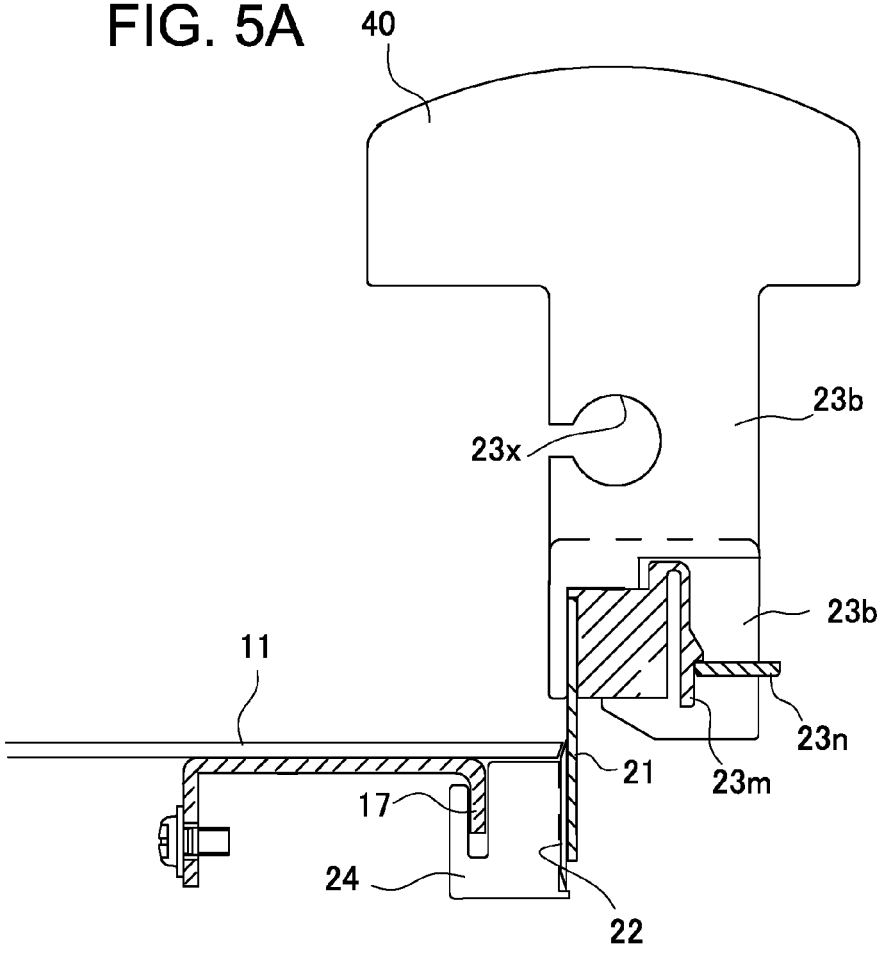
FIG. 5A is a schematic view of a cutter unit of the sheet cutter in FIG. 1.
Figure 5B:
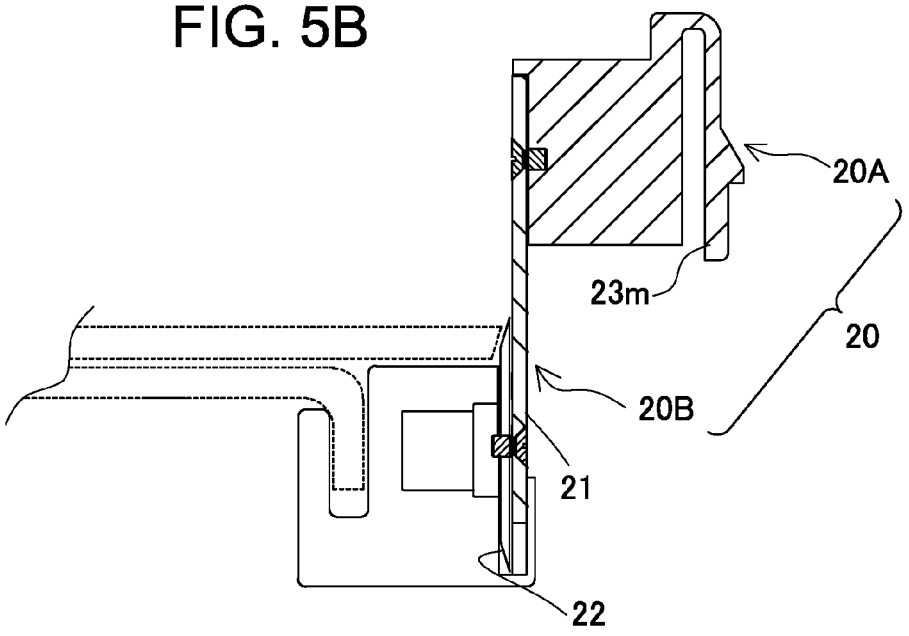
FIG. 5B is an enlarged sectional view illustrating a main part of the cutter unit.

Referring to FIG. 4 showing a cross-section of the sheet cutter 1 of FIG. 1, the placing table 10 supports a sheet S substantially horizontally on the main tray 13 and the sub tray 14, and the cutter unit 20 reciprocates along the first guide member 16 disposed above the placing plane 11 and the second guide member 17 disposed below the placing plane, as described later. The pressurizing mechanism 30 comprises, as described later, a pressing member 31 which is vertically movably supported onto a base frame 15 disposed between the side frames 12*a*, 12*b*.

The first guide member 16 is formed of a rod member having a circular cross-sectional shape, and the second guide member is formed of a rail member having a rectangular cross-sectional shape. The first and second guide members can be alternatively formed to any cross-sectional shape other than circular or rectangular.

[Cutter Unit]

Referring to FIGS. 5A, 5B, 6A and 6B, a structure of the cutter unit 20 will now be explained below. The cutter unit 20 comprises blade members 21, 22 each having a blade edge, and holder members 23, 24 for fixedly mounting the blade members thereon. In the shown embodiment, the cutter unit 20 comprises a first unit 20A disposed above the placing plane 11, and a second unit 20B disposed below the placing plane. The first unit 20A and the second unit 20B are coupled so that their blade edges (knife edges) forma continuous blade edge. In the description below, the first unit 20A is referred as an upper blade structure, and the second unit 20B is referred as a lower blade structure.

The upper blade structure 20A comprises an upper blade member 21 and an upper blade holder member 23. The shown upper blade member 21 is made from a planar blade having cutting edges (knife edges) 21R and 21L for enabling to cut a sheet in either direction of the reciprocating movement of the cutter unit 20, and the cutting edges are formed slanted at a certain angle in a cutting depth direction of the object to be cut S.

The upper blade holder member 23 can be molded from, for example, a resin material, and is provided with an engaging hole 23*x* into which the first guide member 16 is slidably fitted. The upper blade member 21 is integrally connected to the upper blade holder member 23 by fixing screws 23*z*. The shown upper blade holder member 23 comprises a slider part 23*a* and a blade edge fixing part 23*b* that are adapted to be releasably connected. This enables old-to-new replacement of the blade edge fixing damage of the blade edge.

The slider part 23*a* is provided with the engaging hole 23*x*, and the blade edge fixing part 23*b* is formed with threaded holes 23*y* for rotatably mounting the upper blade member 21. An engaging pawl 23*n* is formed to one of the slider part 23*a* and the blade edge fixing part 23*b*, and a locking part 23*m* is formed to the other, so as to engage with each other by elastic deformation of either one of them to connect the slider part 23*a* and the blade edge fixing part 23*b*.

Figure 6A:
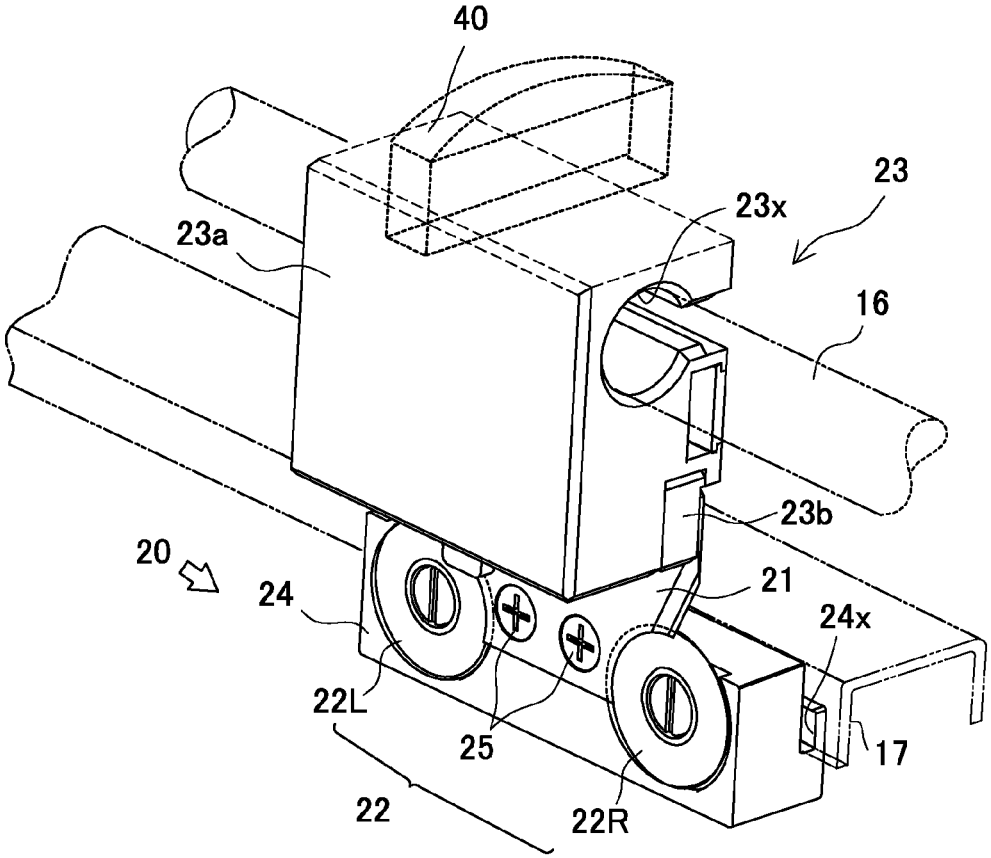
FIG. 6A is a overall perspective view of the cutter unit.
Figure 6B:
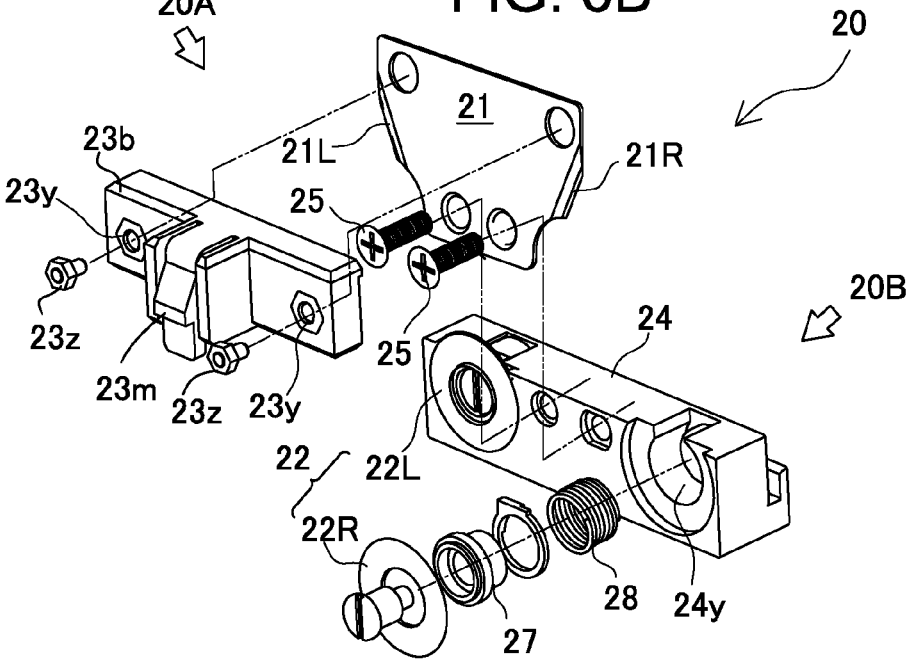
FIG. 6B is an exploded perspective view of the same.
Figure 7A:
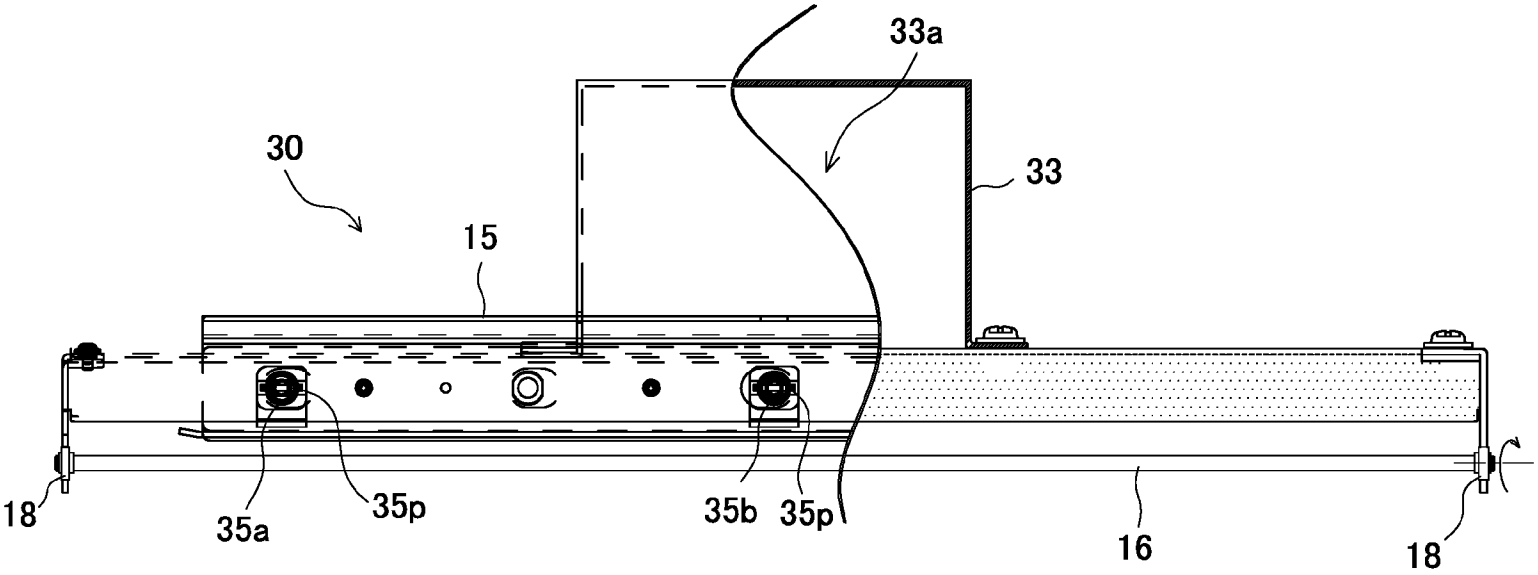
FIG. 7A is a plan view illustrating a pressing mechanism of the sheet cutter in FIG. 1.
Figure 7B:
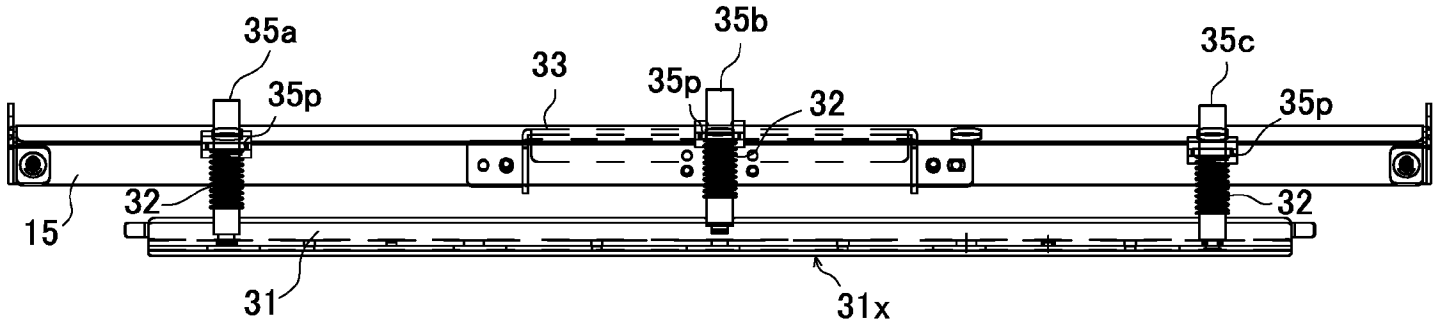
FIG. 7B is a front view of the same.

Referring to FIGS. 6A and 6B, the lower blade structure 20B will now be described below. The lower blade structure 20B comprises a lower blade member 22 and a lower blade holder member 24. The shown lower blade member 22 includes a first circular blade 22R and a second circular blade 22L rotatably mounted to the lower blade holder member 24 for enabling to cut a sheet in either direction of the reciprocating movement of the cutter unit 20.

The upper blade member 21 and the lower holder member 24 are integrally connected by fixing screws 25. The upper blade structure 20A and the lower blade structure 20B are connected so that the cutting edges of the first circular blade 22R and the second circular blade 22L fixedly mounted to the lower blade holder member 24 and the cutting edges of the upper blade member 21 are continued to each other in a cutting depth direction of the object to be cut (sheet) S.

The lower blade members 22 (the first circular blade 22R and the second circular blade 22L) shown in FIGS. 6A, 6B are embedded in the fitting holes 24*y* through collar members 27 and compression springs 28. Here, the collar members 27 rotatably support the lower blade members 22, and the compression springs 28 bring the first circular blade 22R and the second circular blade 22L into pressure-contact with the upper blade member 21.

[Cutting Operating Member]

The cutter unit 20 has a manually operated knob 40 which is formed integrally with the upper blade holder member 23 to reciprocate the cutter unit along the first guide unit 16 and the second guide member 17 within a certain stroke L. This manual knob 40 (hereinafter as cutting operating member) is manually operated by an operator to move the position of the cutter unit 20 along the first and the second guide units 16, 17. The cutting operating member 40 can also be connected optionally to the upper blade holder member 23, or to the lower blade holder member 24, or to either the upper blade member 21 or the lower blade member 22.

[Guide Mechanism]

Referring to FIGS. 4 and 6, the guide mechanism for slidably supporting the first and second holder members 23, 24 will be described below. Between the left and right side frames 12*a*, 12*b*, the first guide member 16 and the second guide member 17 are disposed above and below the placing plane 11. The first guide member 16 comprises a guide rod mounted between the side frames 12*a*, 12*b* above the placing plane 11. The second guide member 17 comprises a rail member mounted to a frame of the placing table 10 below the placing plane 11.

The first guide member 16 and the second guide member 17 are arranged in parallel to each other and along a preset cutting line (y-y in FIG. 2) running from one end Cs to the other end Ce of a sheet bundle on the placing plane 11. The first and second guide members 16, 17 can be formed into any shape such as a rod shape and a channel shape, any cross-sectional shape such as circular, rectangular, L-shape and U-shape, without being limited to any particular shape.

As shown in FIG. 6A, the first holder member 23 is supported to slide in an axial direction with the fitting hole 23*x* fitted with the first guide member 16 of a rod shape. Also the second holder member 24 is supported to slide in an axial direction with a fitting groove 24*x* engaged with the second guide member 17.

In the present invention, it is not essential to guide the cutter unit 20 by a pair of parallel guide members, and therefore one of the first and second guide members 16, 17 can be omitted, so far as the cutter unit is able to reciprocate a certain distance or stroke.

[Pressurizing Mechanism]

Referring to FIGS. 7A, 7B, 8A and 8B, the pressurizing mechanism for maintaining the object to be cut (sheet) S will be described below. The pressurizing mechanism 30 (hereinafter as "pressing part") comprises a pressing member 31, a biasing part 32, and a pressing operating member 33.

In the shown device, the base frame 15 (in the drawing, a steel channel member) is disposed between the side frames 12*a*, 12*b*, and the pressing member 31 for pressing and keeping the object to be cut (sheet) S onto the placing plane is supported by the base frame 15 to move vertically between a non-pressing position Wp and a pressing position Ap. And the pressing member 31 is urged by the biasing spring (biasing part) 32 to be retained at the non-pressing position Wp (hereinafter as "standby position") remote from the object to be cut (sheet) S on the placing plane 11. The pressing member 31 is connected to the pressing operating member 33 which presses it down to the pressing position Ap against the urging force of the biasing spring 32.

Figure 8A:
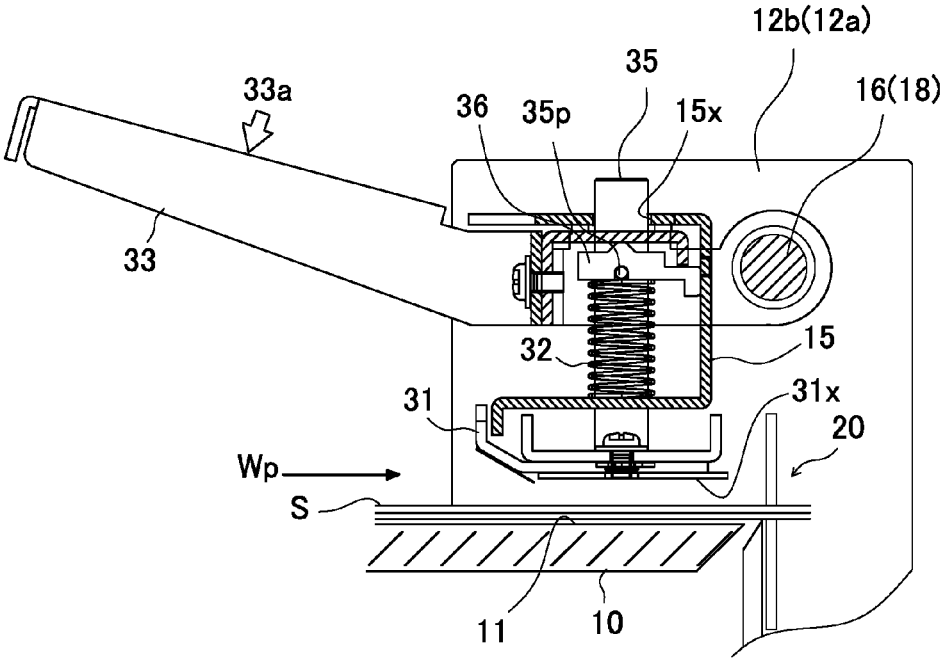
FIG. 8A is a cross-sectional view illustrating the pressing mechanism when sheets are placed on the seat placing plane.
Figure 8B:
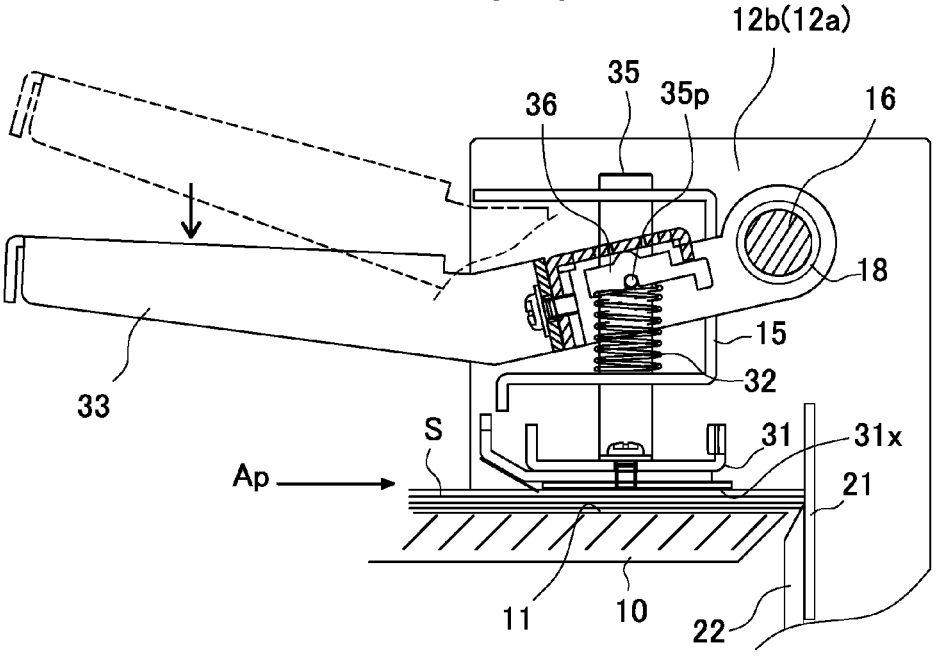
FIG. 8B illustrates when the sheets are cut.

FIG. 8A shows the pressing member 31 located at the non-pressing position Wp, and FIG. 8B shows the pressing member 31 located at the pressing position Ap. The pressing member 31 has a pressurization surface 31*x* which is in parallel to the placing plane 11 and is mounted to a plurality of supporting stems 35 (35*a*, 35*b*, 35*c*) at a certain interval.

The supporting stems 35*a*-35*c* are fitted into bearing holes 15*x* formed in the base frame 15 respectively and are bearing supported to move vertically. Each supporting stem 35*a*-35*c* is provided with a penetrating pin 35*p*, so that each one end of the biasing springs 32 wound around the stems is engaged therewith. Other ends of the biasing springs 32 are engaged with and supported by the base frame 15, so that their biasing forces urge the supporting stems 35 to retain the pressurization surface 31*x* at the non-pressing position Wp.

The supporting stems 35*a*-35*c* being urged toward a non-pressurizing state by the biasing springs 32 are each engaged with pressurizing cams (plate members) 36 (in the drawing, the penetrating pins 35*p* and the pressurizing cams 36 are engaged with each other). The pressurizing cams 36 are engaged with the pressing operating member 33.

The pressing operating member 33 comprises the operating lever which is fittedly mounted to and swingably supported by the rotation supporting shaft 18 (a common shaft shared by the first guide member 16). The pressing operating member 33 has a pressurizing part 33*a* formed to a shape adapted to be pressed down by an operator, is supported by the rotation supporting shaft 18 to swing thereabout, and is always urged toward the non-pressing position Wp by the biasing part (biasing spring) 32.

Accordingly, when the pressurizing part 33*a* is pressed down by the operator, the pressing operating member 33 lowers the supporting stems 35 against the urging force of the biasing part (biasing spring) to press the pressing member 31 down onto a pressing position (a state illustrated in FIG. 8B.

Figure 2:
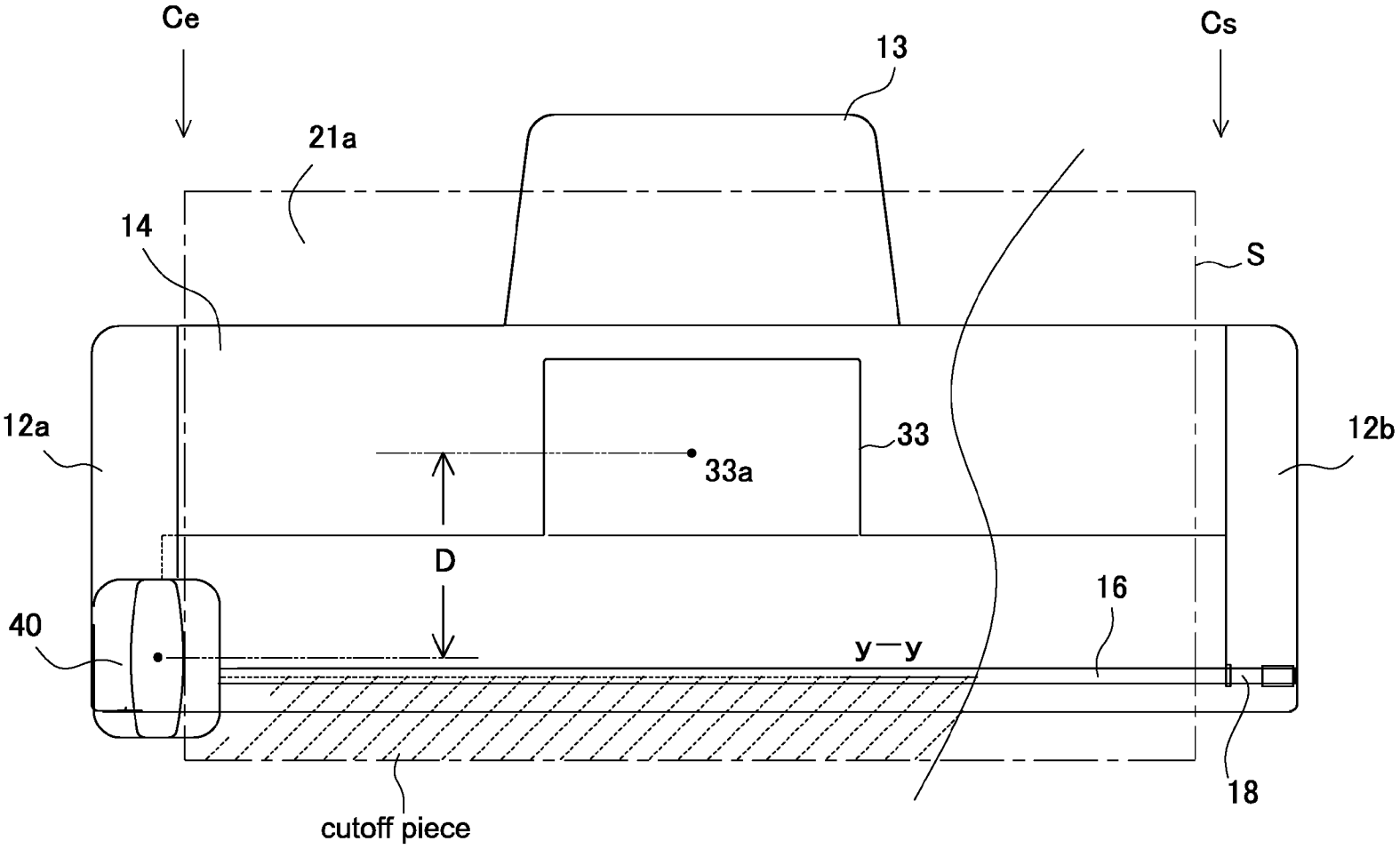
FIG. 2 is a plan view of the sheet cutter in FIG. 1.

In the present invention, the pressing operating member 33 and the cutting operating member 40 are located at different positions apart from each other by a distance D (see FIG. 2). In this embodiment, the operating direction X of the pressing operating member 33 is set to be perpendicular to the placing plane of the placing table 10, for example, to vertical when the placing surface is horizontal, and the operating direction Y of the cutting operating member 40 is set to horizontal.

Thus, a press pressure provided to the pressing operating member 33 retains the placing table 10 and the object to be cut (sheet) S placed thereon in position, and prevents the placing table 10 and the object to be cut (sheet) S from shifting due to a cutting force of the blade members 21, 22 exerted in a cutting direction as well.

Also, while pressing the pressing operating member 33 down with one hand, an operator is expected to move the cutting operating member 40 along the cutting line y-y with the other hand. Because the pressing operating member 33 and the cutting operating member 40 are arranged at different positions with a distance therebetween, a risk of injuring the hand and fingers is prevented.

[Punching Mechanism]

Now referring to FIGS. 9A, 9B, 10A-10D, and 11A-11C, a cutting mode and a punching mode of operation will now be described below. The sheet cutter B is incorporated with the cutter unit 20 and a punch unit 50. A pressing operating member 51 is provided with a switch mechanism between a transmission part to transmit a motion (operating force) of the pressing operating member to the cutter unit 20, and another transmission part to transmit the motion to the punch unit 50.

Figure 9A:
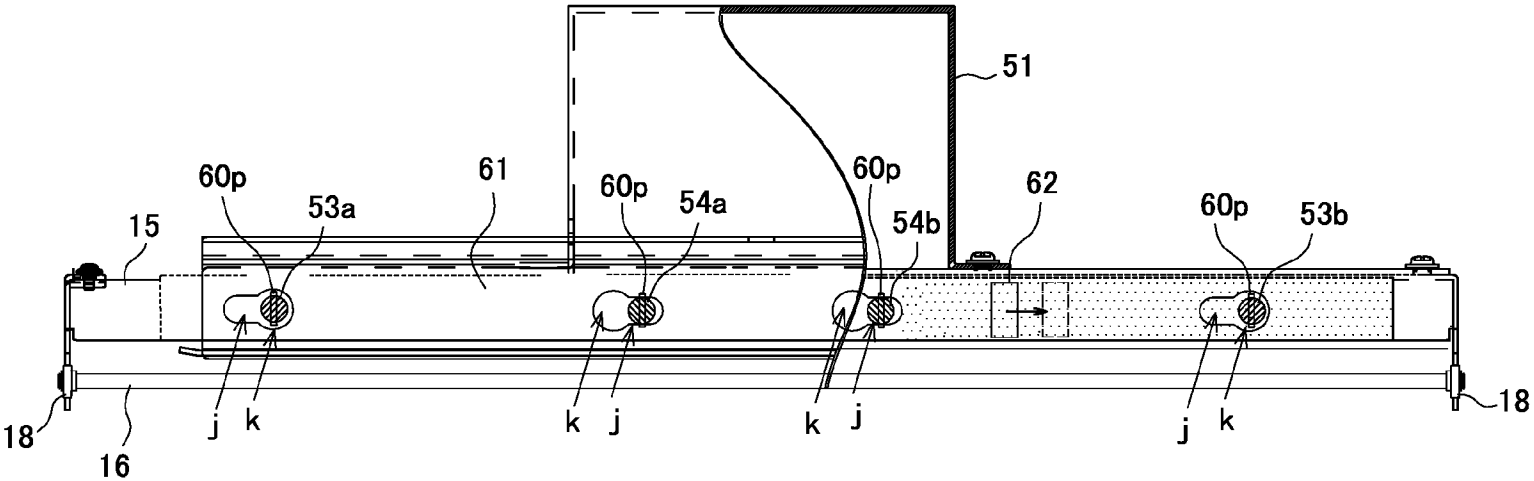
FIG. 9A is a plan view illustrating another embodiment of the sheet cutter having a punching mechanism.

As shown in FIG. 9A, the base frame 15 (in the drawing, a steel channel member) fixed to the placing table 10 is provided with a plurality of supporting stems 53*a*, 53*b* arranged laterally at a distance, and a pair of punching member 54*a*, 54*b* spaced a certain distance apart and arranged at different positions from the supporting stems. The supporting stems 53*a*, 53*b* and the punching member 54*a*, 54*b* are each fitted into a pair of upper and lower bearing holes 15*x* formed in the base frame 15 and are supported to move vertically upward and downward in a pressurizing direction.

The supporting stems 53*a*, 53*b* are fixedly connected at the tips to the pressing plate 55 (pressing member), and the pressing plate 55 is constituted to move upwards and downwards with its pressurization surface 55*x* kept in parallel to the placing plane 11. The pressing plate 55 is also formed at positions where the punching members 54*a*, 54*b* move vertically with through holes 55*y*, so that the punching members 54*a*, 54*b* can project downwards from the pressurization surface 55*x* of the pressing plate 55 through the through holes.

The placing table 10 is formed with blade receiving holes or dies 57 into which are inserted blade edges of the punching members 54*a*, 54*b*. Also, a punch chips storing box (not shown) is provided below the placing table 10.

Figure 9B:
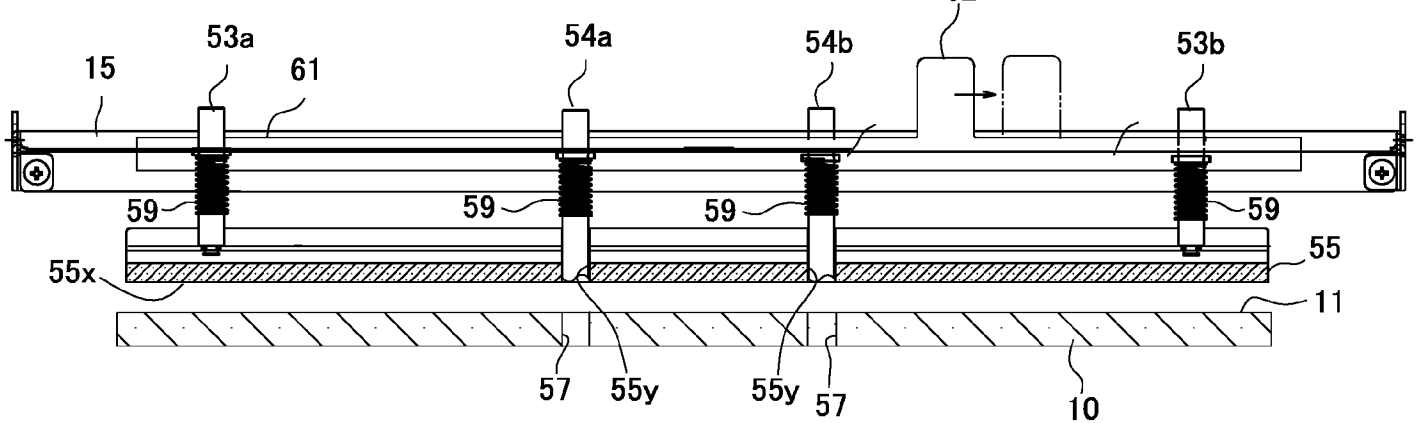
FIG. 9B is a front view of the same.

As shown in FIG. 9B, the first guide member 16 is provided between the left and right side frames 12*a*, 12*b* in the same manner as in the embodiment of FIG. 1, and the cutter unit (not shown) may be provided to be reciprocatingly movable along the guide member 16. The cutter unit has substantially the same structure as that of the previous embodiment, and therefore further explanation is omitted.

The side frames 12*a*, 12*b* are provided with the rotation supporting shaft 18 (for example a common shaft shared by the first guide member 16), and the pressing operating member 51 is pivotally supported to swing about the rotation supporting shaft. Hereinafter, the pressing operating member 51 will be referred as a "swing lever". A swinging motion of the swing lever 18 about the rotation supporting shaft is transmitted to the supporting stems 53*a*, 53*b* so as to cause it to perform a pressing operation, and also transmitted to the punching members 54*a*, 54*b* so as to cause it to perform a punching operation.

Biasing springs 59 are wound around the supporting stems 53*a*, 53*b* and the punching members 54*a*, 54*b*, and lower ends of the springs are engagingly locked on the base frame 15. Upper ends (free ends) of the biasing springs 59 are engaged with penetrating pins 60*p* which penetrate the supporting stems 53*a*, 53*b* and the punching members 54*a*, 54*b*, so that the stems 53*a*, 53*b* and the members 54*a*, 54*b* are always biased upwards away from the placing plane 11. The penetrating pins 60*p* are arranged to engage with a pressurizing cam member 61 that is provided at the swing lever 51.

As shown in FIGS. 10A to 10D, the pressurizing cam member 61 is formed with engaging parts j1 which are adapted to engage with the penetrating pins 60*p* of the supporting stems 53*a*, 53*b*, and non-engaging parts k1 which are adapted not to engage with these penetrating pins. The pressurizing cam member 61 is also formed with engaging parts j2 which are adapted to engage with the penetrating pins 60*p* of the punching members 54*a*, 54*b*, and non-engaging parts k2 which are adapted not to engage with these penetrating pins, at a certain distance.

Each engaging part j1, j2 and its adjacent non-engaging part k1, k2 are spaced at a constant distance apart. Therefore, the pressurizing cam member 61 when located at a position shown in FIG. 10A, may engage with the supporting stems 53*a*, 53*b*, and when located at a position shown in FIG. 10C, may engage with the punching members 54*a*, 54*b*.

Figure 10A:
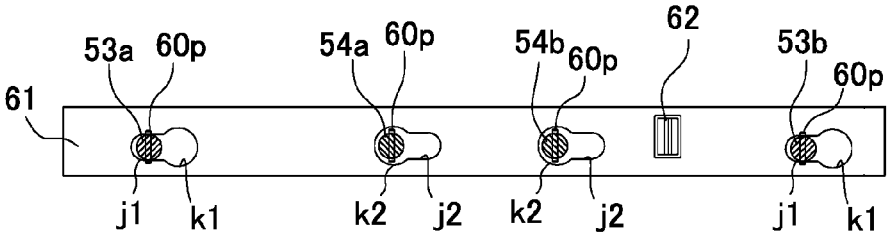
FIGS. 10A and 10C are plan views and FIGS. 10B and 10D are front views of the embodiment in FIGS. 9A and 9B, illustrating switching between a cutting operation in FIGS. 10A and 10B, and a punching operation in FIGS. 10C and 10D.
Figure 10B:
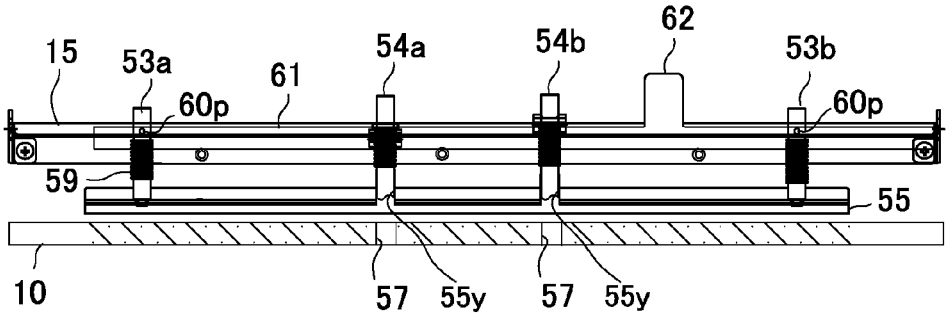

Thus, when the pressurizing cam member 61 is located as shown in FIG. 10A, it may engage with the supporting stems 53*a*, 53*b* so as to move them downward against the biasing spring 59. On the other hand, the punching members 54*a*, 54*b* are each maintained at an initial standby position, because they are located in the non-engaging parts k2.

Figure 10C:
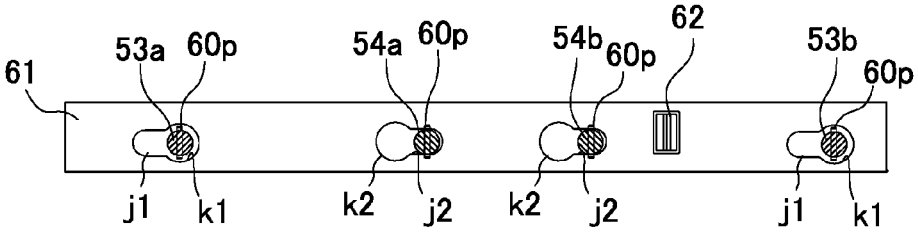
Figure 10D:
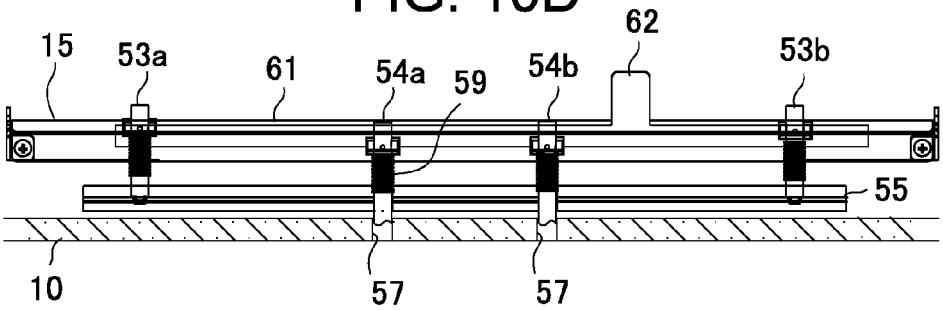

When the pressurizing cam member 61 is located as shown in FIG. 10C, it may engage with the punching members 54*a*, 54*b* so as to move them downward against the biasing spring 59. On the other hand, the supporting stems 53*a*, 53*b* are each maintained at an initial standby position, because they are located in the non-engaging parts k1.

The pressurizing cam member 61 is incorporated in the swing lever 41 so as to move in relation to the supporting stems 53*a*, 53*b* and the punching members 54*a*, 54*b*. In the illustrated embodiment, a switch knob 62 is engaged at its one end with the pressurizing cam member 61, so as to move integrally with the cam member in its longitudinal direction.

Figure 11A:
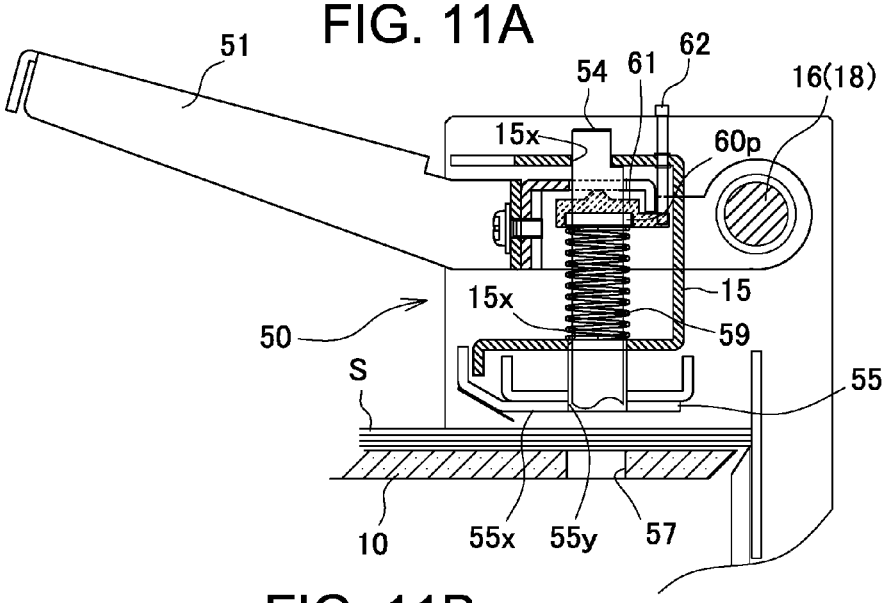
FIG. 11A is a cross-sectional view illustrating the sheet cutter in FIGS. 9A and 9B in a pre-punching position.
Figure 11B:
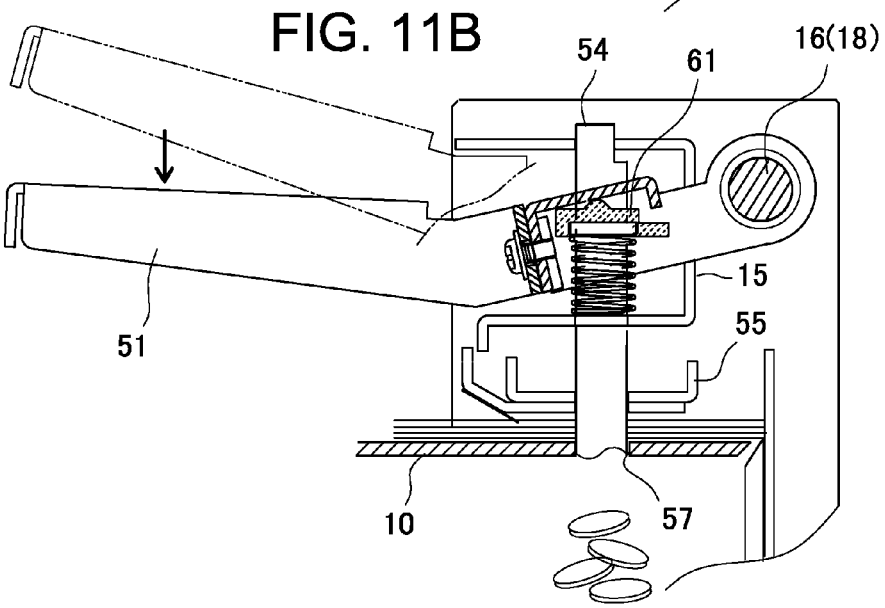
FIG. 11B is in a post-punching position.
Figure 11C:
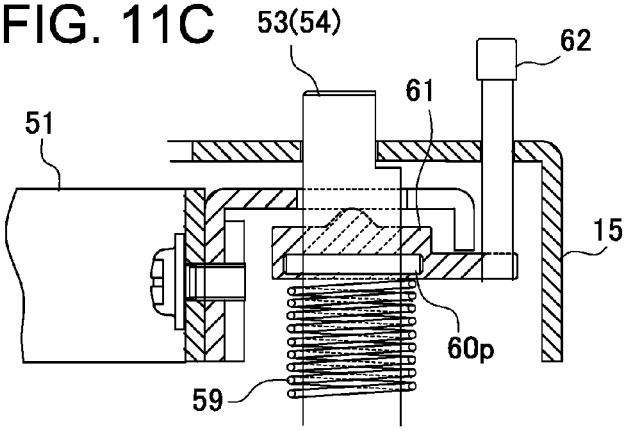
FIG. 11C is an enlarged partial view of a main part of the punching mechanism.

FIG. 11A shows the punching members 54 located at each standby position, FIG. 11B shows the punching members 54 located at each operating position (punching position), and FIG. 11C illustrates a structural relationship of the switch knob 62 and the base frame 15. The swing lever 51, when left on standby without being operated, is maintained at the standby position as shown in FIG. 11A by the biasing force of the biasing spring 59 disposed between the lever and the base frame 15.

The swing lever 51, by being pressed down to the position shown in FIG. 11B, lowers the pressurizing cam member 61 against the biasing spring 59. Then, by virtue of the penetrating pins 60*p*, the punching members 54 are lowered and the punch blade edges thereof are inserted into the die or blade receiving holes 57 to punch holes in the sheets S.

As shown in FIG. 11B, in performing a punching operation on the sheets S on the placing plane 11, the pressurizing cam member 61 is set at a punching position where the engaging parts j2 are aligned with the punching members 54, by operating the switch knob 62. At the same time, the cutter unit 20 is shifted to a position along the guide members corresponding to a central part of the sheets, so that the sheets can be properly positioned, for example, by bringing side edges of the sheets into contact with a back side of the upper blade member 21.

Thus, according to the preferred embodiment of the invention, by using the cutter unit 20 as a stopper member, the sheets on the placing plane 11 can be precisely positioned at the punching position, eliminating a need for additional special parts or structure therefor. For that purpose, it is only necessary to arrange the punching members 54 at appropriate positions based on a traveling line of the cutter unit 20.

Also, though not illustrated in the drawings, the pressurizing cam member 61 can be set at another position where the non-engaging parts k are aligned with the punching members 54*a*, 54*b*, and the engaging parts are aligned with the supporting stems 53*a*, 53*b*, by operating the switch knob 62. When the swing lever 51 is not operated, the pressing member 55 and the punching members 54 are located at the standby positions away from the sheets S on the placing plane 11 by the biasing springs 59.

The swing lever 51, by being pressed down to a pressing position, lowers the pressurizing cam member 61 against the biasing spring 59. Then, by virtue of the penetrating pins 60*p*, the pressing members 55 are lowered to the position for pressing the sheets S on the placing plane 11. On the other hand, the punching members 54*a*, 54*b* are each maintained at the standby position, because they are located in the non-engaging parts k2.

Thus, according to the illustrated embodiment of the present invention, a user can select the cutting mode and the punching mode of operation, for example, by operating the switch knob 62. Further, a punching operation for punching a hole or holes in a sheet or sheets or the like and a trimming operation for cutting edges of bundled or stacked sheets to be aligned can be selectively performed with a simple structure by, for example making the operating member or operating lever common for both the operations.

What is claimed is:

1. A sheet cutter comprising:

a placing table having a placing surface for horizontally supporting an object to be cut;

a cutter unit for cutting the object to be cut on the placing surface;

a pressing part for depressing the object to be cut to be horizontally held on the placing table; and a guide member for movably supporting the cutter unit between one end and another end of the placing table;

wherein the cutter unit comprises:

a holder member being slidably supported by the guide member, and a blade member being attached to the holder member;

the blade member comprises:

an upper blade member having a linear blade edge being arranged orthogonal to the placing surface and slanted at an acute angle in a cutting depth direction of the object to be cut, and a lower blade member having a circular blade edge being arranged orthogonal to the placing surface;

the lower blade member protrudes upwardly from the placing surface at an upper end portion of the circular blade edge to overlap the upper blade member, and at a vicinity of an apex of the upper end portion of the circular blade edge protruding upwardly from the placing surface, the upper end portion of the circular blade edge is intersected with the linear blade edge at an acute angle so that the linear blade edge and the circular blade edge form a continuous cutting edge continuously extending from above the placing surface in the cutting depth direction of the object to be cut;

the guide member has a first and a second guide members being vertically arranged through the placing surface disposed therebetween;

the holder member has a first holder member to slidably engage with the first guide member, and a second holder member to slidably engage with the second guide member; and the upper blade member is attached to the first holder member, and the upper blade member and the lower blade member are attached to the second holder member.

2. The sheet cutter according to claim 1, wherein the cutter unit further comprises a cutting operating member for travelling the holder member along the guide member;

the pressing part comprises a pressing member movable between a pressing position where the object to be cut is pressed on the placing table and a non-pressing position, and a pressing operating member for pressing the pressing member down from the non-pressing position to the pressing position; and the pressing operating member and the cutting operating member are arranged at different positions with a certain interval therebetween to set operating directions of the pressing operating member and the cutting operating member orthogonal to each other.

3. The sheet cutter according to claim 2, wherein the operating direction of the pressing operating member is set to be vertical to the placing surface of the placing table, and the operating direction of the cutting operating member is set to be parallel to the placing surface of the placing table.

4. The sheet cutter according to claim 2, wherein the pressing operating member has an operating lever being swingable about a pivot axis, the cutting operating member has an operating nob connected to the cutter unit, and the operating lever and the operating nob are arranged side by side above the placing surface.

5. The sheet cutter according to claim 1, wherein the first holder member includes a slider part slidably engaging the first guide member, and a blade edge fixing part to which the upper blade member is attached; and the slide part and the blade edge fixing part are detachably connected.

6. The sheet cutter according to claim 1, wherein the placing table is provided with a punch unit for punching a hole in an object to be punched on the placing table, the punch unit comprises a punching member movable between a punching position and non-punching position, and a punching operating member for pressing the punching member down from the non-punching position to the punching position.

7. The sheet cutter according to claim 6, wherein the punching position of the punching member is adjacent a part of the cutter unit to which the object to be punched is abutted.

8. The sheet cutter according to claim 6, wherein the placing table is further provided with a pair of side frames, a rod member extending between the side frames, and an operating lever being swingably mounted to the rod member, and a swinging motion of the operating lever is selectively transmitted to the punching member or to the pressing member.

9. The sheet cutter according to claim 8, wherein a switch is provided between the operating member, the punching member and the pressing member for selectively transmitting the swinging motion of the operating member to the punching member or to the pressing member.

10. The sheet cutter according to claim 1, wherein the lower blade member contacts the upper blade member with pressure through a spring.

11. The sheet cutter according to claim 1, wherein the cutter unit is reciprocated along the guide member; and the upper blade member includes a second linear blade edge, and the lower blade member includes a second circular blade.

12. The sheet cutter according to claim 11, wherein the planar blade has a reverse trapezoidal shape, and the first linear blade edge and the second linear blade edge are formed at two sides of the reverse trapezoidal shape.

13. The sheet cutter according to claim 1, wherein a lower side of the linear blade edge of the upper blade member extends downwardly to a position lower than an intersection point between the linear blade edge and the circular blade edge, and a portion under the lower side of the linear blade edge is roundly cut along a circumferential edge of the circular blade edge to overlap the lower blade member.

* * * * *